United States Patent [19]

Real et al.

[11] Patent Number: 5,007,630

[45] Date of Patent: Apr. 16, 1991

[54] EXERCISE TREADMILL

[75] Inventors: Kenneth G. Real, Redmond; Gary M. Bang, Edmonds, both of Wash.

[73] Assignee: Precor Incorporated, Bothell, Wash.

[21] Appl. No.: 255,546

[22] Filed: Oct. 7, 1988

[51] Int. Cl.[5] ..... A63B 22/02

[52] U.S. Cl. ..... 272/69; 272/DIG. 4

[58] Field of Search ..... 272/69; 108/144, 147; 190/861.5

[56] References Cited

U.S. PATENT DOCUMENTS

| | | | |
|---|---|---|---|
| D. 211,801 | 7/1968 | Quinton | D34/5 |
| D. 250,604 | 12/1978 | Roesch | D25/52 |
| D. 273,029 | 3/1984 | Kullenberg | D21/192 |
| D. 291,007 | 7/1987 | Reisinger et al. | D25/74 |
| 759,296 | 5/1904 | Morairty | 272/69 |
| 931,394 | 8/1909 | Day . | |
| 2,117,957 | 5/1938 | Heller | 272/69 |
| 3,118,705 | 1/1964 | Stalnacke | 108/147 |
| 3,509,674 | 5/1970 | Birum, Jr. | 52/302 |
| 4,035,979 | 7/1977 | Koreska | 52/737 |
| 4,151,988 | 5/1979 | Nabinger | 272/69 |
| 4,344,616 | 8/1982 | Ogden | 272/69 |
| 4,429,502 | 2/1984 | Kinnebrew, IV | 52/263 |
| 4,544,152 | 10/1985 | Taitel | 272/69 |
| 4,591,147 | 5/1986 | Smith et al. | 272/69 |
| 4,602,779 | 7/1986 | Ogden | 272/69 |
| 4,643,418 | 2/1987 | Bart | 272/69 |
| 4,664,371 | 5/1987 | Viander | 272/69 |

OTHER PUBLICATIONS

Portions of an Advertising Brochure Distributed by the Burdick Corporatiion Illustrating the Models TMS-300 and TMS-400 Treadmills.

An Advertising Sheet Illustrating the ICR Whispermill Treadmill Distributed by Instruments for Cardiac Research, Inc.

Portions of an Advertising Brochure Distributed by Haden Industries, Inc. Illustrating the Haden Woodway Treadmill.

Portion of an advertising Brochure Distributed by Universal/Kidde, Inc., Illustrating Treadmills Marketed Under the Designations Tredex Nos. 2902 and 2921.

Advertising Matrial Distributed by MacLevy Products Corp. Illustrating Various Treadmills Marketed Under the Designations "Jog Master, Jog-O-Matic, Cardio Fitness and Tunturi".

Advertising Material Distributed by MGI Fitness Systems Illustrating Treadmill Models 23N and 23P.

Advertising Materials for the Delo Treadmill.

Advertising Material Distributed by Pacer Industries, Inc. Illustrating Treadmill Models R1, R2, R2D, R3, R3 Digital, R9 and R9 Medical.

Advertising Materials Distributed by Trotter Treadmills, Inc. Illustrating Treadmill Models C22, Trotter 320 and Trotter 3100.

Advertising Materials Distributed by Quinton Instrument Co. Illustrating Treadmill Models 18-49, 18-60, 24-72 and 18-54.

*Primary Examiner*—Richard J. Apley

*Assistant Examiner*—D. F. Crosby

*Attorney, Agent, or Firm*—Christensen, O'Connor, Johnson & Kindness

[57] ABSTRACT

An exercise treadmill (10) includes a self contained lift mechanism (24) extending upwardly from a forward central portion of a frame structure (12) adjacent the forward end of an endless belt (14) supported by an underlying deck (20) and defining a running surface. This mechanism is operated by a hand crank that is rotatable by a user while standing on the treadmill running surface. The frame structure (12) includes a pair of side rails (30,31) each having inside, top and outside wall portions (48,46,52). Each of the wall portions includes an interior groove extending substantially along their entire lengths wherein the interior of the groove is configured to receive hardware members at any location along the groove or directly receive the threaded ends of threaded hardware members used to mount the deck (20) and other components to the frame structure (12).

30 Claims, 5 Drawing Sheets

EXERCISE TREADMILL

TECHNICAL FIELD

The present invention relates to exercise equipment; and, more particularly, to an exercise treadmill that is designed to reduce the steps needed to assemble the treadmill and also designed to conveniently vary the angle of inclination of the treadmill.

BACKGROUND OF THE INVENTION

Exercise treadmills are now widely used in gymnasiums, spas, clinics and in private homes for aerobic exercise, physical examinations and physical therapy, for instance, during recovery from a cardiac illness. An exercise treadmill in its simplest form includes an endless belt that is moved over an underlying support bed, either by the walker's or runner's feet, or by an electrical motor. Not uncommonly, exercise treadmills now employ microcomputers that control the speed of the drive motor, monitor an individual's workout, and provide output displays indicating various conditions, such as time, speed, distance, and calories expended.

To render the exercise treadmill more versatile, it may be positioned at various inclinations to simulate running or walking up a grade. Various mechanisms have been employed to raise the front end of an exercise treadmill relative to the floor or other support surface on which the unit is positioned. For instance, in one type of exercise treadmill, the forward end of the endless belt, associated bed and belt support frame must be manually lifted and engaged with or clamped to upstanding posts. It may not be possible for elderly or physically infirm persons to lift the treadmill belt, deck and frame in this manner. Examples of such exercise treadmills are disclosed in U.S. Pat. Nos. 931,394 and 2,117,957.

In another type of treadmill lift mechanism, the elevation of the forward end of the treadmill is adjusted by manually rotating threaded leg members located at the front corners of the treadmill frame using a wrench or similar hand tool. This method is too slow and cumbersome for most treadmill users. An example of this type of exercise treadmill is disclosed in U.S. Pat. No. 4,151,988.

In a related type of exercise treadmill tilting mechanism, the threaded leg members are trained together by a chain or belt assembly, and a hand crank is mounted on one or both of the legs to rotate the legs in unison. A drawback of this type of elevation-adjusting device is that the runner/walker must leave the endless belt to adjust the height of the screw feet. Also, the drive train components used to interconnect the two screw legs together result in a complicated, heavy mechanism. An example of this type of exercise treadmill is disclosed by U.S. Pat. No. 4,602,779.

In a further type of exercise treadmill, spring mechanisms are employed to carry substantially all of the weight of the forward end of the treadmill frame to provide a substantially "zero-bias" so that the treadmill may be readily raised and lowered to a desired operating position. However, a manually operable clamping mechanism typically must be employed to lock the tilting/supporting means in a desired position. Thus, to change the angle of inclination of a treadmill, the user must dismount the treadmill, move to the front of the treadmill, and reach down to manually operate the locking device. This is not only a cumbersome procedure, but also it may not be possible for elderly or infirm persons to loosen the locking device, lift or lower the treadmill frame, and then sufficiently retighten the locking device to prevent it from shifting during use of the exercise treadmill. Examples of the foregoing type of treadmill elevating device are disclosed by U.S. Pat. Nos. 4,591,147 (assigned to the assignee of the present application) and 4,664,371.

Another common disadvantage of known exercise treadmills, including many of those noted above, is that a substantial number of assembly steps are required, both during the initial preassembly of the machine at the manufacturing location, and also during the final assembly by the ultimate user of the equipment. This is not only time-consuming and expensive, but also oftentimes requires special skills and tools, which many persons do not possess.

Summary of the Invention

The present invention addresses the disadvantages of prior art exercise treadmills discussed above by providing an exercise treadmill composed of a frame structure, a deck mounted on the frame structure for supporting an endless belt that defines a running surface and a self-contained lift mechanism extending upwardly from a forward central portion of the frame structure adjacent the front of the endless belt. The lift mechanism is conveniently operable by rotation of a hand crank by the user while standing on the endless belt.

In accordance with a particular aspect of the present invention, the self-contained lift mechanism includes an elongate outer post assembly secured to a forward central portion of treadmill frame structure, and, in particular, to the underside of the treadmill frame. The self-contained lift mechanism also includes a ground-engaging inner post assembly telescopically disposed within the outer post assembly to extend downwardly beneath the outer post assembly. A lead screw is interconnected between the inner post assembly and the outer post assembly whereby rotation of the lead screw with the hand crank in a first direction causes the lift mechanism to extend and thus lift the forward end of the treadmill, and rotation of the lead screw in the opposite direction causes the lift mechanism to retract and thus lower the forward end of the treadmill.

In accordance with another aspect of the present invention, a rotatably actuated potentiometer is driven by the lead screw to monitor the relative engagement between the outer post assembly and the inner post assembly of the lift mechanism. Thus, the electrical signal emitted by the potentiometer is related to the elevation of the exercise treadmill.

In accordance with a further aspect of the present invention, the frame structure of the exercise treadmill includes a pair of laterally spaced-apart longitudinal side rails each having top, inside and outside wall portions. An inside shoulder extends along the inside wall portion to define a load-bearing member for supporting the side edges of the treadmill deck. An upwardly open first groove extends along the inside shoulder, with the interior of the groove configured to engage threaded fasteners for securing the deck to the side rails. An upwardly open second groove also extends along the top wall portion of the side rails, with the interior of the second groove configured to engage threaded fasteners employed to mount cap or trim members that overlie the top of the side rails.

In accordance with yet another aspect of the present invention, a third, outwardly open groove extends along the outside wall portion of the side rails. The interior of the third groove is configured to receive fastener members that are employed to attach handrail mounting brackets to the exterior sides of the frame side rails.

BRIEF DESCRIPTION OF THE DRAWINGS

One embodiment of the present invention is illustrated in the accompanying drawings, in which.

DETAILED DESCRIPTION OF THE INVENTION

Figure 1:
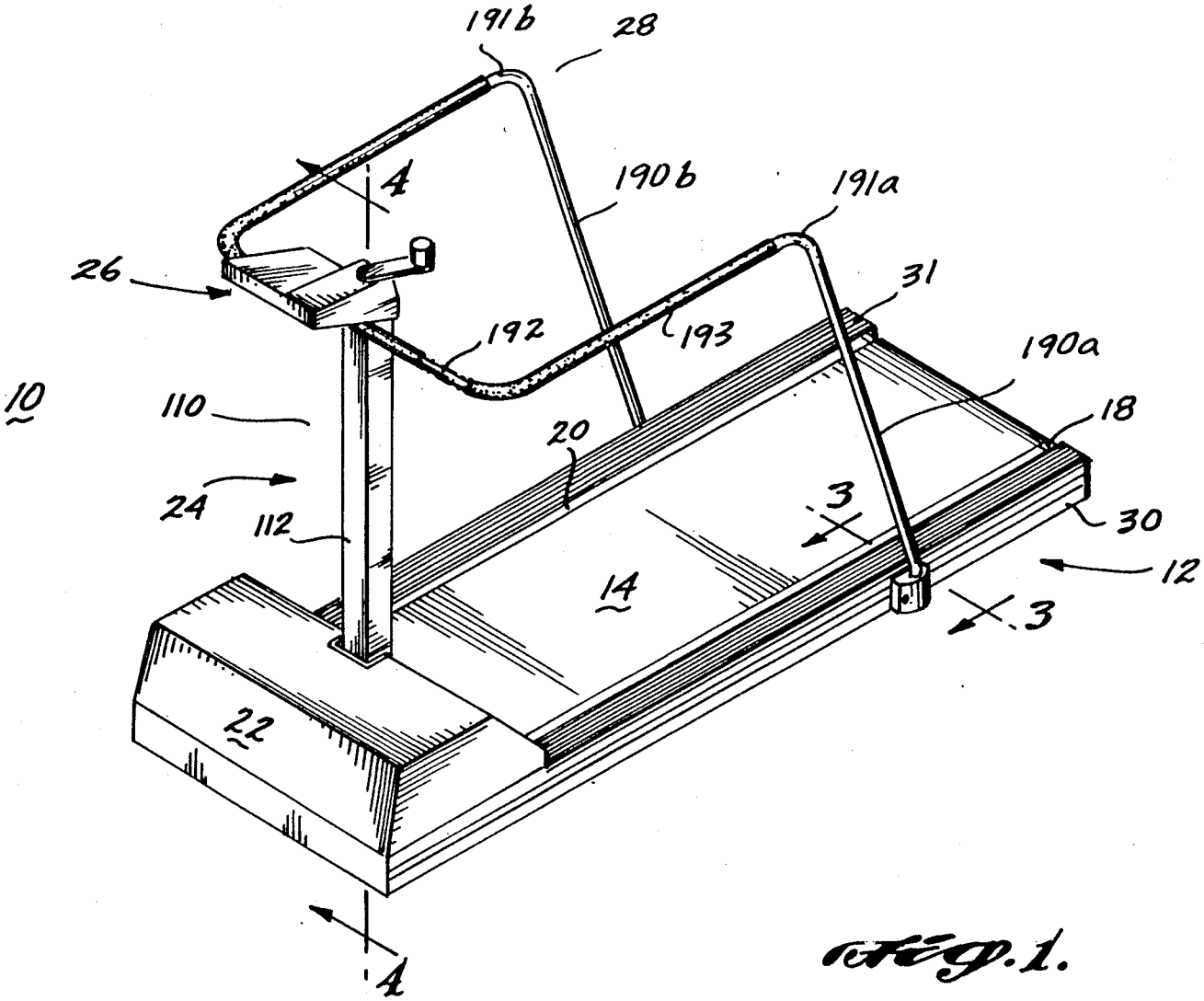
FIG. 1 is an isometric view of the exercise treadmill of the present invention as viewed from the forward end of the unit.
Figure 2:
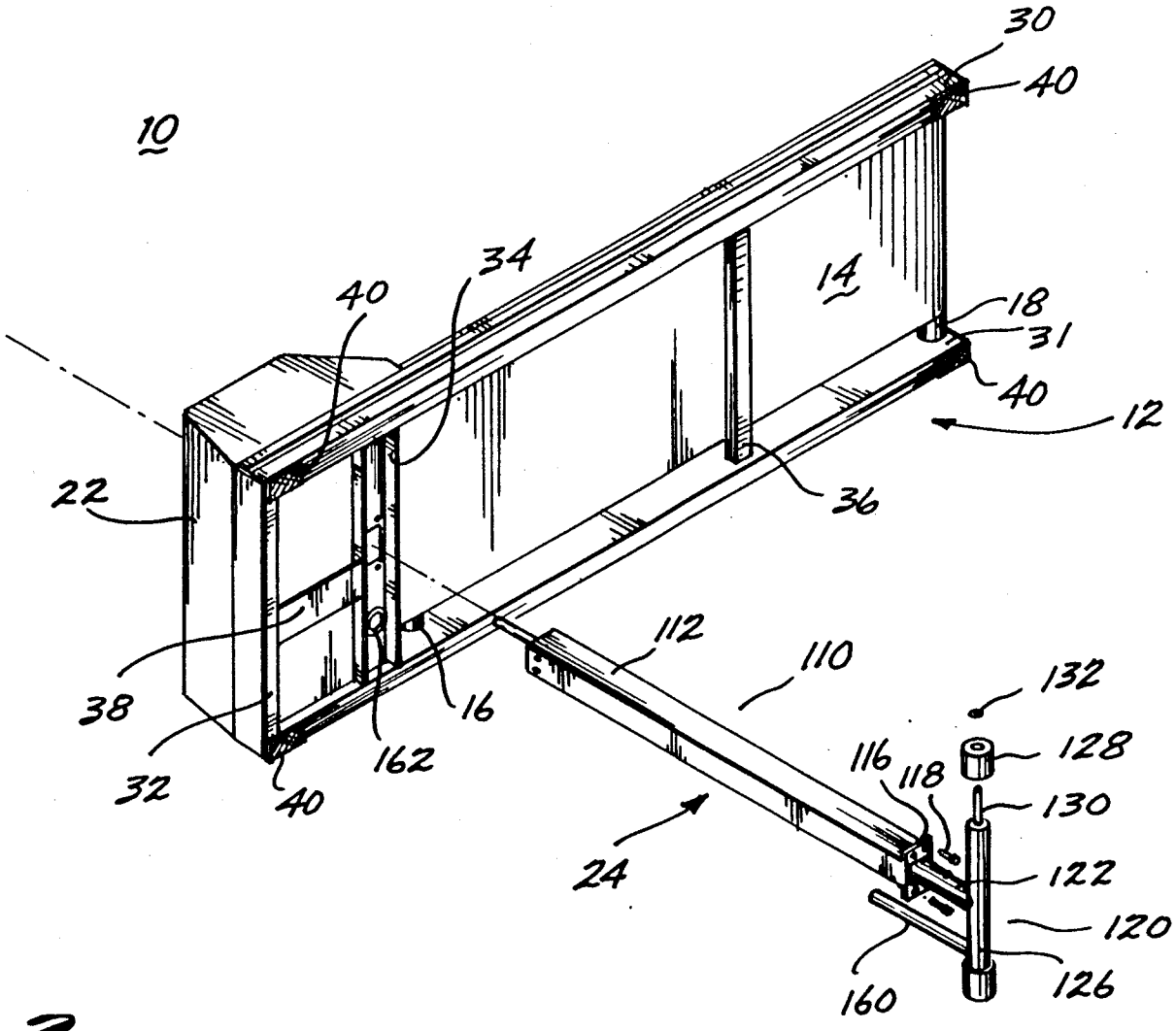
FIG. 2 is an isometric view of the exercise treadmill illustrated in FIG. 1 specifically showing the underside of the unit with portions of the lift mechanism exploded away for clarity.

Referring initially to FIGS. 1 and 2, an exercise treadmill 10 is illustrated as including frame structure 12 on which is mounted an endless belt 14 trained over a forward drive roller 16 and a rear driven roller 18, both axled on the frame structure. A platform or deck 20 closely underlies and supports the upper run of the endless belt 14. Preferably, the drive roller 16 is powered by an electric motor, not shown, disposed within a housing 22 mounted on the forward end of the frame structure 12. A lift mechanism 24 extends upwardly from a central forward portion of the treadmill 10, rearwardly of the front end on the frame structure 12 and adjacent the forward end of the endless belt 14 to tilt the forward end of the treadmill 10 at desired altitudes to simulate an incline or hill. A display assembly 26 is mounted on the upper end of the lift mechanism 24. A microprocessor, not shown, is housed within the display assembly 26 to calculate and display various workout parameters, including, for instance, lapsed time, speed, distance traveled, and the angle or percent of incline of the treadmill. A handle rail structure 28 extends upwardly from both sides of the frame structure 12, longitudinally forwardly and then laterally across the front portion of the treadmill adjacent the top of the lift mechanism 24, FIG. 1.

Next, describing the foregoing major subassemblies of the treadmill 10 in greater detail, the frame structure 12 includes a pair of longitudinal, parallel side rails 30 and 31 extending substantially the full length of the treadmill. The side rails are interconnected by a forward crossmember 32, an intermediate crossmember 34, and a rear crossmember 35. Ideally, the crossmembers are configured in standard structural shapes, such as angle-shaped, channel-shaped or tubular. However, the crossmembers can be in other forms, such as a solid bar of various cross sections. A longitudinal brace 38 extends between the forward side of the intermediate crossmember 34 and the forward crossmember 32. The brace 38 also may be formed in numerous cross-sectional shapes without departing from the spirit or scope of the present invention. In addition, it is to be understood that the frame structure 12 may employ crossmembers and braces in addition to crossmembers 32, 34 and 36 and brace 38, as required to provide rigidity and structural integrity. Ground-engaging front and rear foot pads 40 are disposed beneath the side rails 30 and 31 at the front and rear of the frame structure 12. Ideally, the foot pads 40 are composed of a durable, relatively hard elastomeric material to prevent the treadmill 10 from shifting during use while at the same time not marring the underlying floor.

Figure 3:
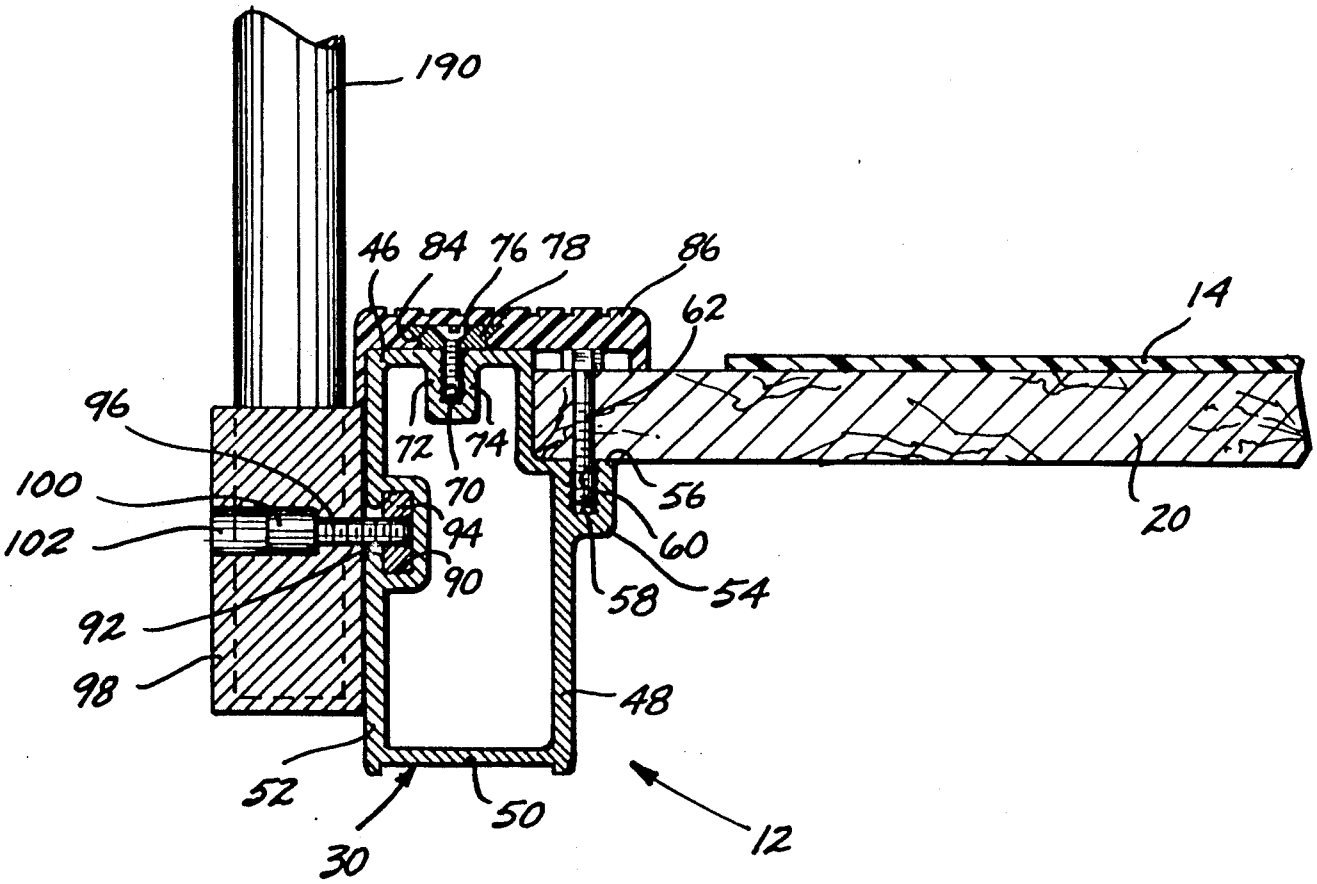
FIG. 3 is an enlarged fragmentary cross-sectional view of the exercise treadmill of the present invention taken substantially along lines 3—3 of FIG. 1.

Additionally referring to FIG. 3, the side rails 30 and 31 are constructed as mirror images of each other. Thus, the construction of the side rail 30 will be described in detail, with the understanding that side rail 31 is similarly constructed. Side rail 30 is generally rectangular in shape and ideally substantially hollow in form, composed of a top wall 46, an inside wall 48, a bottom wall 50 and an outside wall 52. The four walls 46-52 are illustrated as being of substantially the same cross-sectional thickness; however, the thickness of the walls may be varied to accommodate certain design parameters, such as the loads being carried by the particular walls. Also, rather than being generally rectangular, the side rail 30 may be formed in other cross-sectional shapes without departing from the spirit or scope of the present invention.

The inside wall 48 is formed with a shoulder or ledge 54 extending substantially the full length of the rail 30 and projecting laterally inwardly toward the longitudinal center of the frame structure 12. The shoulder 54 defines an upwardly directed load-bearing surface 56 for supporting the adjacent side edge portion of the treadmill deck 20. An upwardly open hardware-receiving groove 58 is formed within the shoulder 54 and extends substantially along the entire length of the shoulder. Ideally, the inside walls of the groove 58 are contoured to define ridges or teeth 60, which are sized and spaced to coincide with the thread pitch of bolts 62 which extend downwardly through clearance holes formed in the treadmill deck 20 to engage within the groove 58. In essence, the teeth 60, extending the full length of the groove 58, cause the groove 58 to function as a linear thread extending the full length of the shoulder 54. Thus, threaded fasteners, such as bolts 62, may be spaced apart along the side edge of the deck 20 at various locations and still engage with the teeth 60. Ideally, the side rail 30, including the teeth 60, is formed by an extrusion process so that the teeth need not be separately milled, broached, or otherwise cut or machined after the side rail has been formed.

The top wall 46 of the side rail 30 is shaped or contoured to define an upwardly open groove 70 extending downwardly below the top wall. The groove 70 extends substantially the full length of the side rail. As with groove 58, ideally, the side walls 72 of the groove 30 are formed with integral teeth or ridges 74 sized and spaced apart to coincide with the pitch of the threaded lower end of bevel-headed fasteners 76. As with teeth 60, preferably, the teeth 74 are integrally formed at the time the side rail 30 is extruded, thereby to define a linear thread extending the full length of the side rail. The fasteners 76 engage through the central opening of a button washer 78 having a circular shank portion and a beveled or flared head that is sized to slidably engage with a beveled undercut formed in a shallow, downwardly open groove 84 extending along the underside of trim structure 86. In cross section, the trim structure 86 extends laterally inwardly toward the longitudinal center of the treadmill 10 slightly beyond the innermost portion of the inside wall 48 of the side rail 30, but not as far inward as the location of the adjacent side edge of the belt 14. The trim structure 86 also includes an outer flange portion that extends downwardly to overlap the upper portion of rail outside wall 52. It will be appreciated that, by the foregoing construction, the trim structure 86, which extends from the near side rail 30 to the motor housing 22, is assembled with the side rail by simply sliding the trim structure over the button washers 78 that are spaced along the side rail.

Referring primarily to FIGS. 1 and 3, the outside wall 52 of the side rail 30 is configured to define a groove 90 disposed within the interior of the side rail and extending substantially the entire length of the side rail. As shown in FIG. 3, the groove 90 preferably is generally rectangular in cross section. An entrance opening 92 leads into the groove 90, which entrance opening has a width narrower than the maximum width of the groove. By this construction, the groove is sized and shaped to captively receive a nut plate 94 having tapped openings in alignment with the groove entrance opening 92 for receiving the threaded end of fasteners 96 that extend through clearance openings formed in brackets 98 employed to mount the lower free ends of the handrail assembly 28 to the exterior sides of the frame rails 30 and 31. As shown in FIG. 3, the heads 100 of the fasteners 96 are disposed within counterbores 102 formed in the brackets 98. The brackets 98 have a central bore portion for receiving the lower free ends of the handrail assembly. It will be appreciated that, rather than being shaped to receive nut plate 94, the interior of groove 90 could instead be configured similar to the interiors of grooves 58 and 70 to engage directly with the threaded ends of fasteners. Alternatively, the interiors of grooves 58 and 70 could be configured to receive a nut plate similar to nut plate 94 without departing from the spirit or scope of the present invention, while providing substantially the same advantages provided by forming the grooves 58 and 70 with teeth 60 and 74, respectively.

Figure 4:
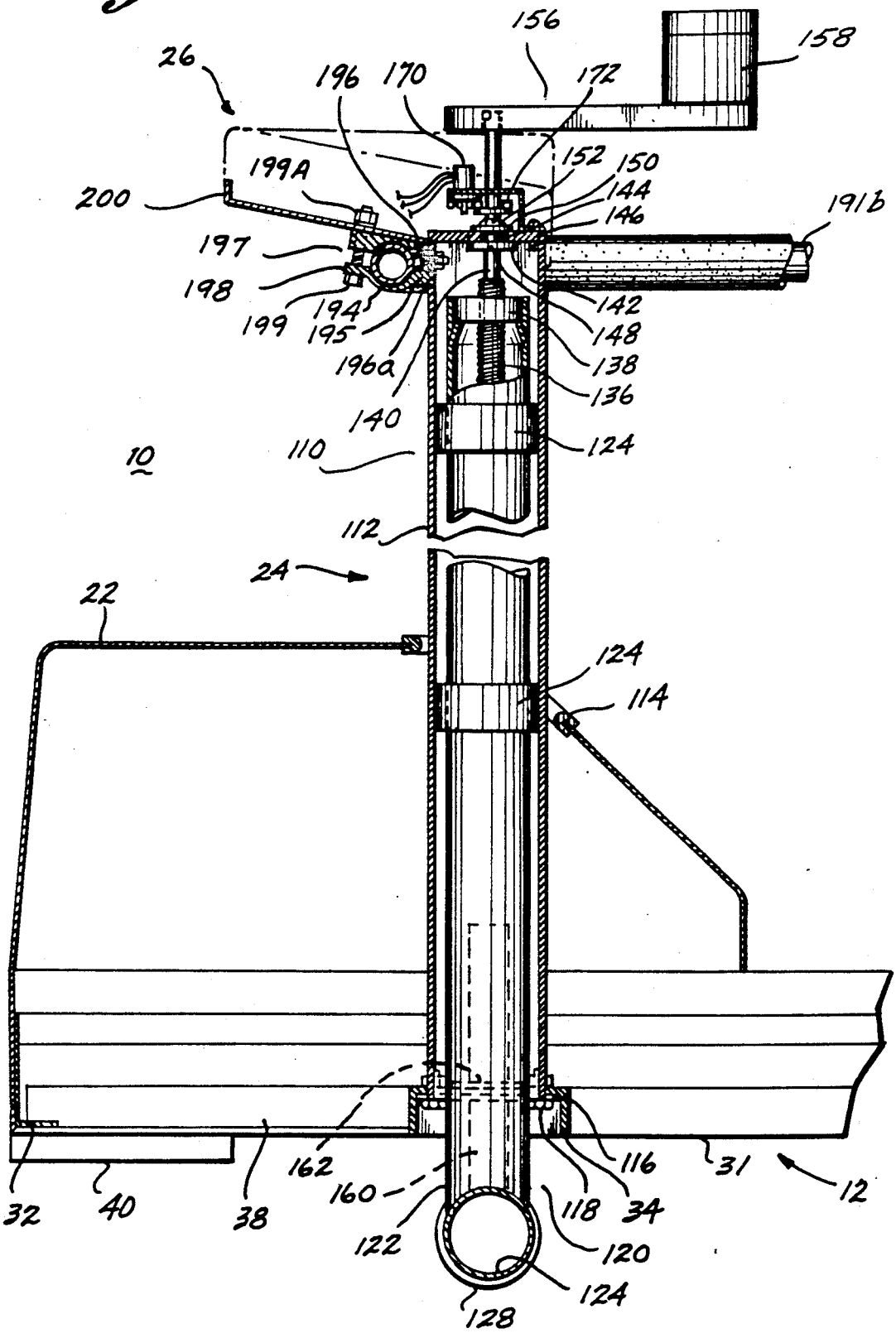
FIG. 4 is an enlarged fragmentary cross-sectional view of the exercise treadmill of the present invention taken substantially along lines 4—4 of FIG. 1; and, FIG. 5 is an enlarged, exploded, fragmentary isometric view specifically illustrating the attachment of the handrail assembly and display assembly to the top of the lift mechanism and the instrumentation employed to measure the angle of inclination of the exercise treadmill.

Next, referring specifically to FIGS. 2 and 4, the self-contained lift mechanism 24 includes an elongate outer post assembly 110 composed of tubular outer post 112 extending upwardly through a close-fitting opening formed in the central portion of the frame crossmember 34, through an aligned opening formed in motor housing 22 and upward a substantial distance above the belt 14 to approximately the elevation of the hips or waist of an average-height person. An elastomeric grommet or seal 114 is interposed between the opening in the motor housing 22 and the exterior of the outer post 112. A pair of flanges 116 are fixedly secured to the bottom of the outer post 112 to extend laterally outwardly in opposite directions from the post. The outer post assembly 110 is detachably secured to frame structure 12 by hardware members 118 that extend upwardly through clearance holes formed in the flanges 116 to engage within threaded openings formed in the frame crossmember 34, with the flanges 116 underlying the frame crossmember 34. It will be appreciated that, by this construction, the lift mechanism 24 may be assembled from the underside of the treadmill and, thus, access to the interior of the motor housing 22 is not required. Although the outer post 112 is illustrated as being composed of square tubing, it is to be appreciated that the post may be constructed in other cross-sectional shapes, such as circular or rectangular.

The lift mechanism 24 also includes an inner post assembly 120 composed of a tubular inner post 122 extending upwardly through the bottom of the outer post 112 and into the interior of the outer post. The inner post 122 is centrally positioned relative to the outer post 112 by a plurality of vertically spaced-apart collars 124 that snugly receive the inner post 122 and closely fit within the interior of the outer post. A ground-engaging tubular crossmember 126 is transversely fixed to the bottom of the inner post 122. Preferably, the length of the crossmember 126 is less than the distance separating the frame side rails 30 and 31 so as to be retractable upwardly between the side rails when the lift mechanism 24 is in fully retracted condition, whereby the treadmill 10 is supported by pads 40 in horizontal position. Rollers 128 are mounted on the ends of the crossmember 126 by an axle 130 extending through the crossmember and outwardly from the ends of the crossmember to engage within close-fitting bores formed in the rollers. The rollers 128 are maintained in engagement with the axle by hardware members which may take the form of, for instance, nuts 132 that engage with the threaded outer ends of the axle. It will be appreciated that the rollers 128 enable the treadmill 10 to be easily moved about from place to place by simply lifting on the opposite end of the treadmill, which end is relatively light in weight, since the motor and other heavier components of the treadmill are located at the forward end of the frame structure 12.

The inner post 122 is telescopically extended and retracted relative to the outer post 112 by rotation of a lead screw 136 that extends a substantial distance downwardly into the interior of the inner post. The lead screw 136 has a lower threaded portion engaged with a centrally threaded member 138, such as an acme nut, fixed within the interior of the inner post 122. The lead screw 136 has a reduced-diameter, nonthreaded stem 140 that extends upwardly through the close-fitting central bore of a stepped collar 142, which collar has a reduced-diameter shank portion 144 snugly engaged within a close-fitting central opening formed in a cap 146 that closes off the top of the outer post 112. To carry the upward forces applied to the outer post by the lead screw, the collar 142 also includes an enlarged-diameter flange portion 148 that bears against the underside of the cap 146 and oppositely against the shoulder, formed by the intersection of the threaded and stem portions of the lead screw. A thrust washer 150 is engaged over the lead screw stem 140 located above the outer post cap 146, and a push nut 152 is downwardly engaged over the stem 140. By this construction, the thrust washer 150 and push nut 152 cooperatively prevent the lead screw 136 and, thus, the inner post assembly 120, form dropping downwardly relative to the outer post assembly 110, for instance, when the forward end of the treadmill 10 is lifted. The thrust washer 150 and push nut 152 do not, however, prevent free rotation of the lead screw 136 relative to the outer post 112.

The stem 140 of the lead screw 136 extends upwardly above the outer post 112 through the housing of the display 26 and upwardly above the display to engage with one end of a horizontal hand crank 156. An upwardly extending, manually graspable knob 158 extends upwardly from the opposite end of the hand crank. Preferably, the knob 158 is rotatably mounted relative to the hand crank so that the knob does not rotate in the user's hand when operating the hand crank. It will be appreciated that when the hand crank 156 is rotated in one direction, the lift mechanism 24 is extended by causing the inner post 122 to move downwardly relative to the outer post 112. When the hand crank is rotated in the opposite direction, the lift assembly is retracted whereby the inner post assembly is moved upwardly relative to the outer post 112. During this telescopic movement of the lift mechanism 24, the inner post 122 is restrained against rotation about its longitudinal axis by a guide tube 160 extending upwardly from the crossmember 126 of the inner post assembly 120 in space-parallel relationship to the inner post 122. The guide tube 160 is sized to closely and slidably extend through the interior bore of a grommet 162 engaged within an opening formed in the frame crossmember 34. It will be appreciated that, by this construction, the guide tube 160 permits the inner post 122 to freely move up and down relative to the outer post 112 while restraining the inner post from rotating relative to the outer post.

It will also be appreciated that, by the foregoing construction, the lift mechanism 24 constitutes a unitary assembly independent from the frame structure 12 which may be quickly and easily attached to the frame structure without requiring any special tools or skill. Moreover, the lift mechanism may be conveniently operated by simply rotating the hand crank 156 while actually standing on the treadmill. Thus, the angle of inclination of the treadmill may be conveniently adjusted without having to lift any portion of the treadmill by hand, or without requiring the loosening and subsequent retightening of any clamps or other fasteners. This is especially important to elderly or injured persons who may not have the physical ability to lift loads of any significant weight or loosen relatively tight hardware members.

Figure 5:
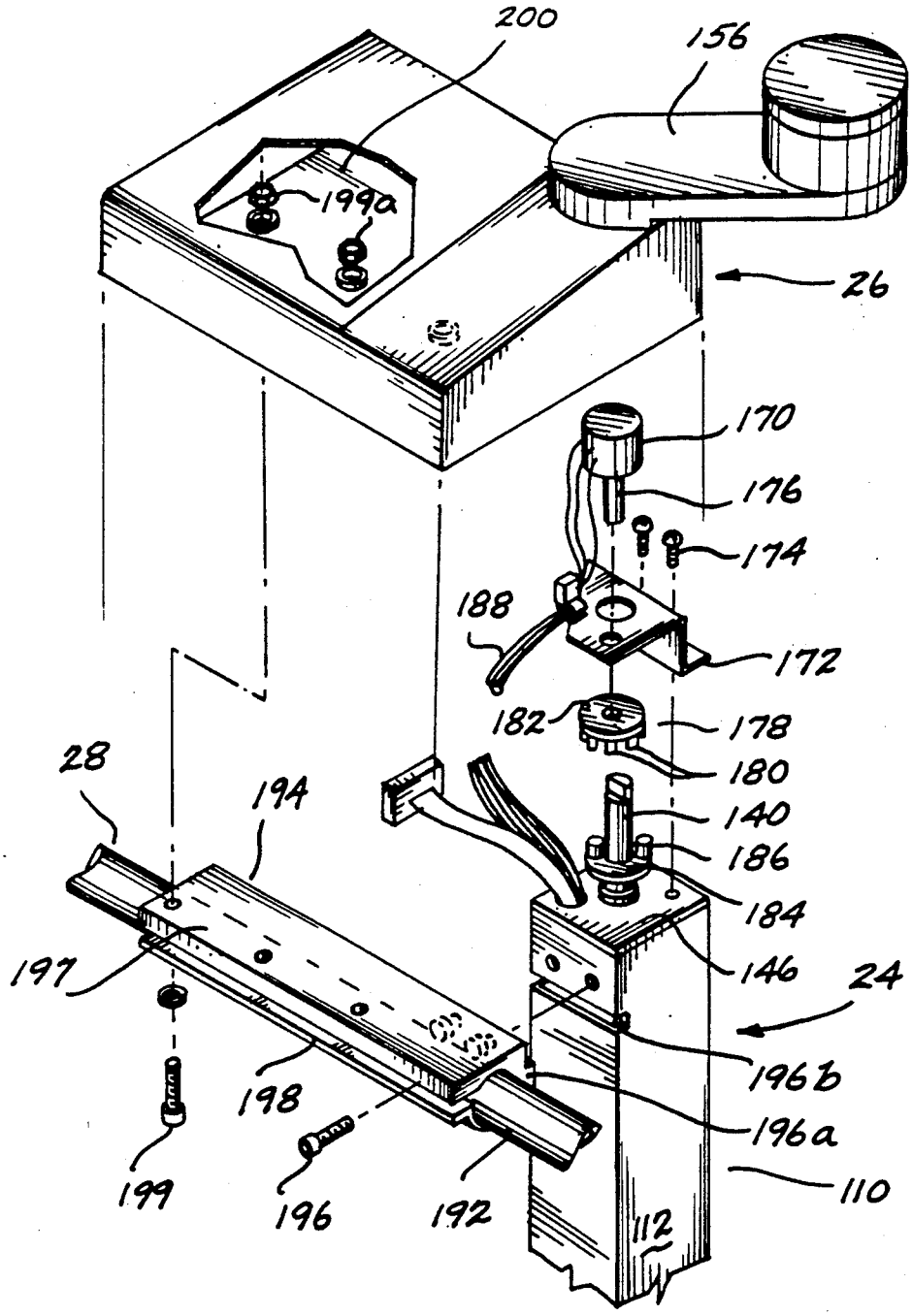

Referring specifically to FIG. 5, the position of the inner post 122 relative to the outer post 112 and, thus, the angle of inclination of the treadmill, is monitored and such information provided to a microprocessor, not shown, located within the display assembly 26 for use in displaying various parameters, including, for instance, the incline of the treadmill, the work being exerted, and the calories being expended by the exerciser. The relative position of the inner and outer posts is measured by a rotatably actuated potentiometer 170 mounted on the upper flange of a Z-shaped bracket 172, with the lower flange of the bracket fastened to the cap 146 of the outer post 112 by hardware members, for instance, screws 174, extending downwardly through clearance holes formed in the lower flange of the bracket to engage within tapped holes formed in the cap. A drive shaft 176 extends downwardly from the potentiometer through a clearance opening formed in the upper flange of the bracket 172 to snugly and antirotationally engage with the central bore of a pinwheel 178. The pinwheel is constructed with a plurality of pin members 180 extending downwardly from the disc portion 182 of the pinwheel. Ideally, the pin members 180 are equally spaced relative to each other to define a circle. The pinwheel 178 is sized and positioned to mesh with a drive wheel 184 snugly engaged over the stem 140 of the lead screw 136. The drive wheel is constructed with a pair of diametrically opposed drive cogs 186 that engage the pinwheel 178 between adjacent pin members 180. Since the number of pin members 180 is greater than the number of drive cogs 186, the drive ratio between the drive wheel 184 and the pinwheel 178 is such that each rotation of the drive wheel results in only a partial rotation of the pinwheel. This is required when the full rotational travel of the potentiometer 176 is less than the full rotational travel of the lead screw 136. Of course, the drive ratio between the drive wheel 184 and the pinwheel 178 may be varied by changing the number of drive cogs 186 relative to the number of pin members 180 to accommodate the relative rotational travels of the potentiometer and lead screw. The electrical signal from the potentiometer 176 is transmitted to the microprocessor circuit, not shown, by an electrical lead 188.

Next, referring specifically to FIGS. 1, 4 and 5, the treadmill 10 also includes a tubular handrail assembly 28 that may be manually grasped by the exerciser when walking or running on the treadmill. The handrail assembly includes generally upright leg sections **190*a* and 190*b* extending upwardly from mounting brackets 98, previously described, to intersect with the rear ends of horizontal handrail sections 191*a* and 191*b* that extend longitudinally forwardly to intersect with the opposite ends of a forward, transverse section 192 that crosses along the front side of the upper end of the outer post 112. Substantial portions of the transverse section 192 and handrail sections 191*A* and 191*B* preferably are covered with a resilient, nonskid grip 193** constructed from any appropriate material, such as expanded foam.

As most clearly illustrated in FIGS. 4 and 6, the transverse section 192 of the handrail assembly 28 is securely fastened to the upper end of the outer post 112 by a transversely extending clamping bracket 194 having a web portion 195 that is disposed in face-to-face relationship with the adjacent forward surface of the outer post. Clearance openings are formed in the web portion 195 for receiving hardware members, for instance, screws 196, that engage with tapped holes formed in the outer post 112. A key **196*a* extends along the lower portion of web 195 to engage a transverse slot 196*b* extending transversely across the forward surface of the outer post 112 to help prevent loosening of screws 196 and to help support the handrail assembly on the outer post. The transverse section 192 of the handrail assembly is clamped between the contoured jaws 197 and 198 of the clamping bracket 194 by threaded fasteners, for instance, bolts 199, that extend upwardly through clearance openings formed in the jaws 197, 198 to threadably engage with nuts 199*a*. The bolts 199 also serve to mount the display assembly 26 to the clamping bracket 194 and, thus, to the upper end of the outer post 112. To this end, close-fitting apertures are formed in the lower panel 200 of the display assembly 26 for receiving the bolts 199. Thus, it will be appreciated that the clamping bracket 194 serves the dual function of securing the handrail assembly 28 to the upper end of the outer post 112 while simultaneously mounting the display 26 to the top of the outer post assembly 110**.

As will be apparent to those skilled in the art to which the invention is addressed, the present invention may be embodied in forms other than those specifically disclosed above without departing from the spirit or essential characteristics of the invention. The particular embodiment of a treadmill 10 described above is therefore to be considered in all respects as illustrative and not restrictive. The scope of the invention is as set forth in the appended claims, rather than being limited to the example or the exercise treadmill 10 set forth in the foregoing description.

The embodiments of the invention in which an exclusive property or privilege is claimed are defined as follows:

1. An exercise treadmill, comprising:

(a) a frame structure;

(b) a deck for supporting an endless belt defining a running surface, the deck mounted on the frame structure;

(c) a self-contained lift mechanism extending upwardly from a forward, central portion of the frame structure to extend upwardly a substantial elevation above the running surface for raising and lowering the forward portion of the treadmill;

(d) wherein the self-contained lift mechanism comprises:

(i) an elongate outer post assembly secured to a forward, central portion of the treadmill frame structure and extending upwardly a substantial elevation above the running surface;

(ii) a ground-engaging inner post assembly telescopically disposed within the outer post assembly to extend downwardly beneath the outer post assembly; and, (iii) means for selectively sliding the inner post assembly relative to the outer post assembly to extend the lift mechanism to raise the forward portion of the treadmill, and to retract the lift mechanism to lower the forward portion of the treadmill;

(e) means for engaging and disengaging the self-contained lift mechanism with the frame structure from the underside of the frame structure; and, (f) means for detachably securing a lower end portion of the self-contained lift mechanism to the underside of the treadmill frame structure and means fixed to the ground engaging inner post assembly to prevent the inner post assembly from rotating relative to the treadmill frame structure while allowing the inner post assembly to raise and lower relative to the treadmill frame structure.

2. The exercise treadmill according to claim 1, wherein the means for sliding the inner post assembly relative to the outer post assembly comprises:

a lead screw interconnected between the inner post assembly and the outer post assembly; and, means for rotating the lead screw in a first direction to extend the lift mechanism and, alternatively, in the opposite direction to retract the lift mechanism.

3. The exercise treadmill according to claim 2, wherein the means for rotating the lead screw comprises a manually operable hand crank connected to the lead screw, said hand crank disposed at the upper end of the lift mechanism.

4. The exercise treadmill according to claim 2, further comprising means for sensing the relative engagement between the outer post assembly and the inner post assembly of the lift mechanism.

5. The exercise treadmill according to claim 4, wherein the sensing means comprises a potentiometer actuated by the rotation of the lead screw.

6. The exercise treadmill according to claim 5, wherein:

the potentiometer is rotatably actuated; and, said sensing means comprises drive train means for rotatably interconnecting the potentiometer to the lead screw.

7. The exercise treadmill according to claim 6, wherein the drive train means comprises means for rotating the potentiometer at a speed different from the rotational speed of the lead screw.

8. The exercise treadmill according to claim 1, further comprising a display panel mounted on an upper portion of the lift mechanism.

9. The exercise treadmill according to claim 8, wherein the means for securing the handrails to the upper portion of the lift mechanism also includes means for mounting the display panel on the upper portion of the lift mechanism.

10. The exercise treadmill according to claim 1, wherein said securing means is accessible from the underside of the treadmill.

11. An exercise treadmill, comprising;

(a) a frame structure;

(b) a deck for supporting an endless belt defining a running surface, the deck mounted on the frame structure;

(c) a self-contained lift mechanism extending upwardly from a forward, central portion of the frame structure to extend upwardly a substantial elevation above the running surface for raising and lowering the forward portion of the treadmill;

(d) a handrail extending upwardly from the frame structure and across a forward portion of the treadmill;

(e) means for securing the handrail to an upper portion of the lift mechanism; and, (f) wherein said frame structure includes a pair of laterally spaced-apart longitudinal side rails, each having top, inside and outside wall portions, each of said side rails comprising;

(i) an inside shoulder extending along the inside wall portion to define a load-bearing member for supporting the endless belt, an upwardly open first groove extending along the inside shoulder, the interior of the first groove configured to engage threaded fasteners for securing the endless belt assembly to the side rails; and, (ii) an upwardly open, second groove extending along the top wall portion of the rail, the interior of the second groove configured to engage threaded fasteners.

12. The exercise treadmill according to claim 11, wherein the interior of at least one of the first and second grooves has side walls contoured to directly engage the threads of threaded fasteners.

13. The exercise treadmill according to claim 12, wherein the longitudinal side rails of the frame further comprise a third, outwardly open groove extending along the outside wall portion of the rails, the interior of the third groove configured to receive threaded fasteners.

14. The exercise treadmill according to claim 13, wherein the interior of the third groove has side walls contoured to directly engage the threads of threaded fasteners.

15. The exercise treadmill according to claim 11, wherein the longitudinal side rails are of substantially hollow construction.

16. A frame for an exercise treadmill having a deck for supporting an endless belt, said frame comprising:

(a) a pair of longitudinal side rails extending along the frame, each of the side rails having top, inside and outside wall portions;

(b) a shoulder extending along the inside wall portions of the side rails to define an upward, load-bearing surface for supporting the side edge portions of the treadmill deck, said shoulders having an upwardly open first groove extending along the shoulders, the interior of the first groove configured to engage first fasteners for securing the treadmill deck to the frame side rails; and, (c) an upwardly open second groove extending along the top wall portions of the rails, the interior of the second groove configured to engage second fasteners substantially along the entire length of the second groove.

17. A treadmill frame according to claim 16, wherein at least one of the first and second grooves extends substantially the entire length of the frame side rails.

18. The treadmill frame according to claim 16, wherein the side walls of at least one of the first and second grooves are contoured to closely receive threaded fasteners.

19. The treadmill frame according to claim 17, wherein the side walls of at least one of the first and second grooves are contoured to directly engage with the threads of threaded fasteners.

20. The treadmill frame according to claim 16, further comprising a third, outwardly open groove extending along the outside wall portions of the longitudinal frame rails, the interior of the third groove configured to receive fasteners.

21. The treadmill frame according to claim 20, wherein the interior of the third groove is contoured to closely receive threaded fasteners.

22. The treadmill frame according to claim 20, wherein the third groove includes interior side walls contoured to directly threadably engage with the threads of threaded fasteners.

23. The treadmill frame according to claim 16, wherein the longitudinal side rails are of substantially hollow construction.

24. A frame for an exercise treadmill having a deck assembly for supporting an endless belt, the frame comprising:

a pair of longitudinal side rails extending along the frame, each of the side rails having top, inside and outside wall portions; and, a shoulder extending along the side rails to define an upward, load-bearing surface for supporting the side edge portions of the treadmill deck, the shoulders having an upwardly open first groove extending there along, the interior of the first groove configured to engage first fasteners for securing the treadmill deck to the frame side rails.

25. The treadmill frame according to claim 24, wherein the first groove extends substantially the entire length of the frame side rails.

26. The treadmill frame according to claim 24, wherein the first groove is contoured to closely receive threaded fasteners.

27. The treadmill frame according to claim 24, further comprising an open second groove extending along the top wall portions of the rails, the interior of the second groove configured to engage second fasteners along the length of the second groove.

28. The treadmill frame according to claim 27, further comprising an open third groove extending along the outside wall portions of the longitudinal frame rails, the interior of the third groove configured to receive fasteners.

29. The treadmill frame according to claim 28, wherein at least one of the second and third grooves extends substantially the entire length of the frame side rails.

30. The treadmill frame according to claim 28, wherein the side walls of at least one of the second and third grooves are configured to closely receive threaded fasteners.

* * * * *